United States Patent [19]

Stedman

[11] 4,122,959

[45] Oct. 31, 1978

[54] BACKHOE WITH MULTI-MOVEMENT CAPABILITIES

[75] Inventor: Robert N. Stedman, Chillicothe, Ill.

[73] Assignee: Caterpillar Tractor Co., Peoria, Ill.

[21] Appl. No.: 795,336

[22] Filed: May 9, 1977

Related U.S. Application Data

[62] Division of Ser. No. 661,088, Feb. 25, 1976, Pat. No. 4,049,139.

[51] Int. Cl.[2] ..... B62D 5/06

[52] U.S. Cl. ..... 314/138 R; 180/139; 280/492

[58] Field of Search ..... 180/134–139; 214/138 R; 280/492

[56] References Cited

U.S. PATENT DOCUMENTS

| | | | |
|---|---|---|---|
| 2,941,612 | 6/1960 | Bernotas | 180/51 |
| 3,240,284 | 3/1966 | Finneman | 280/492 X |
| 3,266,179 | 8/1966 | Golden | 214/138 R |
| 3,807,586 | 4/1974 | Holopainen | 214/138 R |
| 3,912,300 | 10/1975 | Bryan | 180/139 X |

*Primary Examiner*—L. J. Paperner

*Attorney, Agent, or Firm*—Phillips, Moore, Weissenberger, Lempio & Majestic

[57] ABSTRACT

An articulated construction vehicle, such as a backhoe comprises front and rear frames pivotally interconnected together directly by a universal pivot connection and a link universally interconnected between the frames. The link is disposed vertically below the universal pivot connection whereby the frames are adapted for relative pivotal and vertical movement.

8 Claims, 17 Drawing Figures

BACKHOE WITH MULTI-MOVEMENT CAPABILITIES

This is a division, of Ser. No. 661,088, filed Feb. 25, 1976, now U.S. Pat. No. 4,049,139.

BACKGROUND OF THE INVENTION

A standard backhoe normally comprises a dipper stick pivotally mounted for vertical movements on a boom, rotatably mounted for horizontal swinging movements on a rearward end of the backhoe. A bucket is pivotally mounted on a lower end of the dipper stick to provide a work tool for performing a number of operations which are difficult to perform with other types of earthworking machines. The backhoe is particularly useful for work in close quarters wherein the bucket may be moved alongside the backhoe for trenching purposes, for example. The articulated front and rear frames are normally interconnected by a pair of vertically spaced pivot pins.

SUMMARY OF THIS INVENTION

An object of this invention is to provide an improved pivotal connection between the front and rear frames of an articulated vehicle. The connection comprises a single universal pivot means directly interconnecting the frames together for relative pivotal and vertical movement and a single link means disposed vertically below the universal pivot means which is disposed between the ends of the link means.

BRIEF DESCRIPTION OF THE DRAWINGS

Other objects of this invention will become apparent from the following description and accompanying drawings wherein.

DETAILED DESCRIPTION

Figure 1:
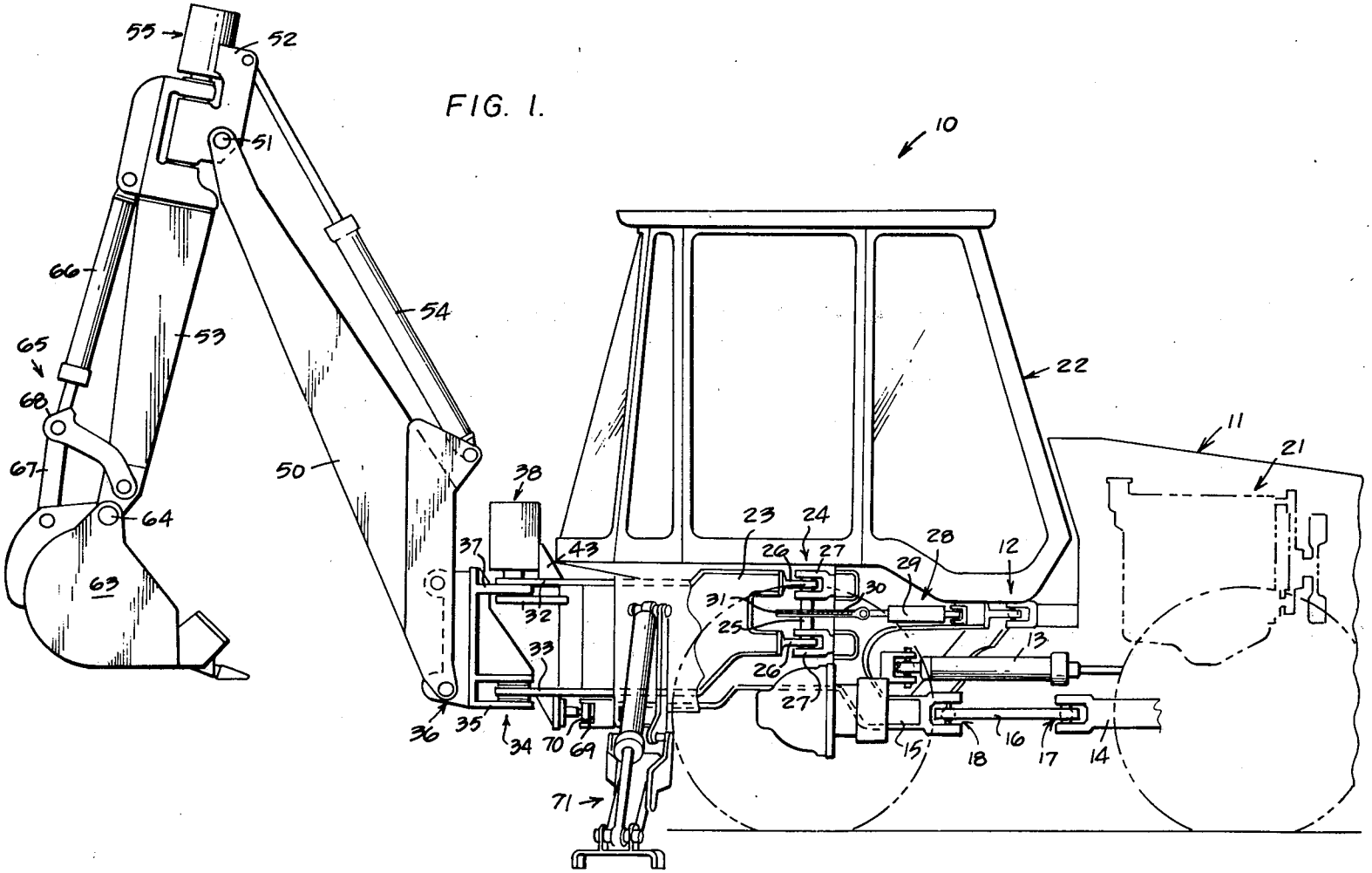
FIG. 1 is a side elevational view, partially schematic, illustrating a backhoe of this invention with portions broken away to expose internal constructions thereof.
Figures 2, 6:
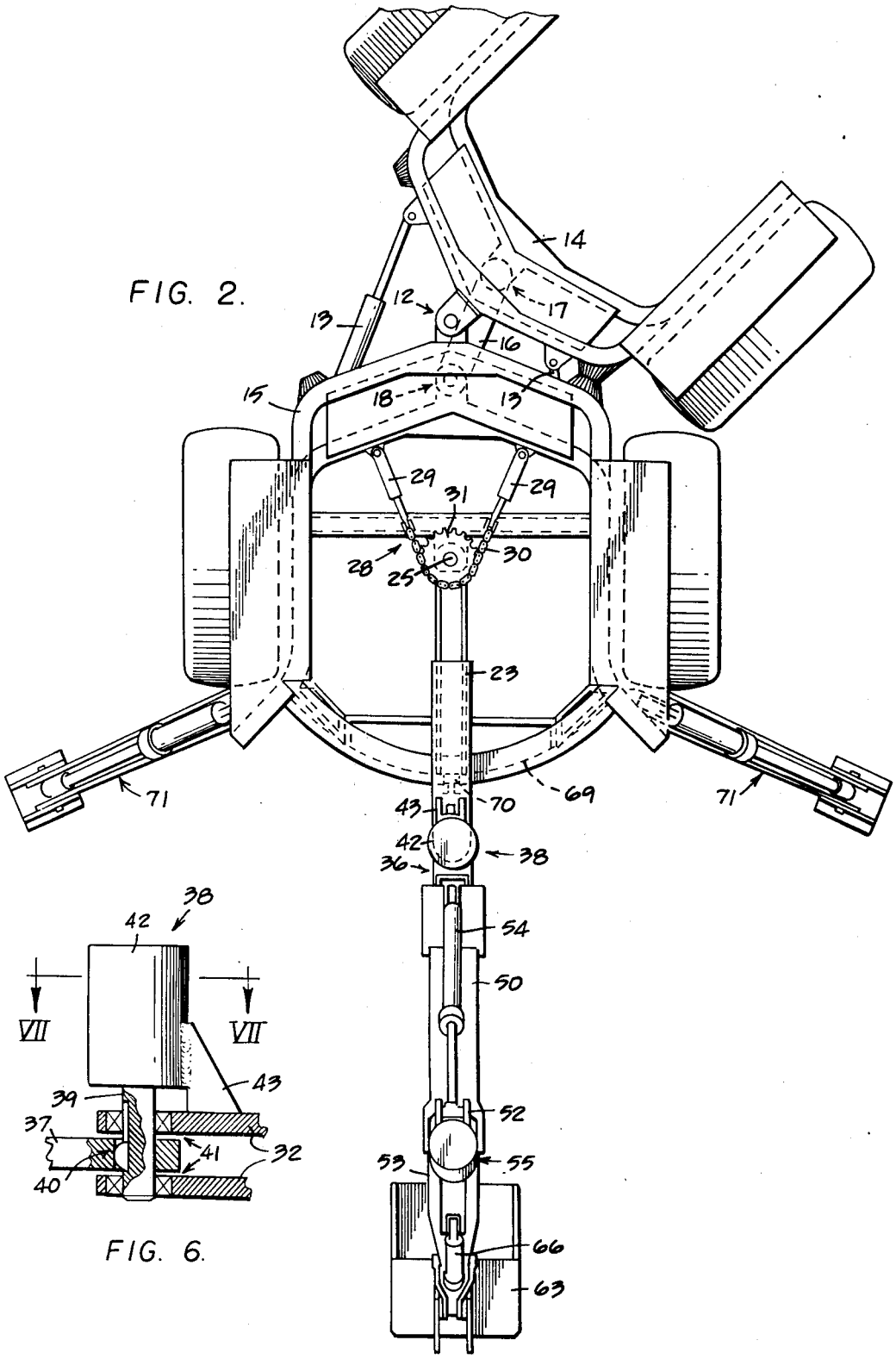
FIG. 2 is a top elevational view of the backhoe, but with an operator's station and attendant structures removed therefrom for clarification purposes.
FIG. 6 is an enlarged and partially sectioned side elevational view of a first hydraulic swing motor and mounting therefor.
Figure 3:
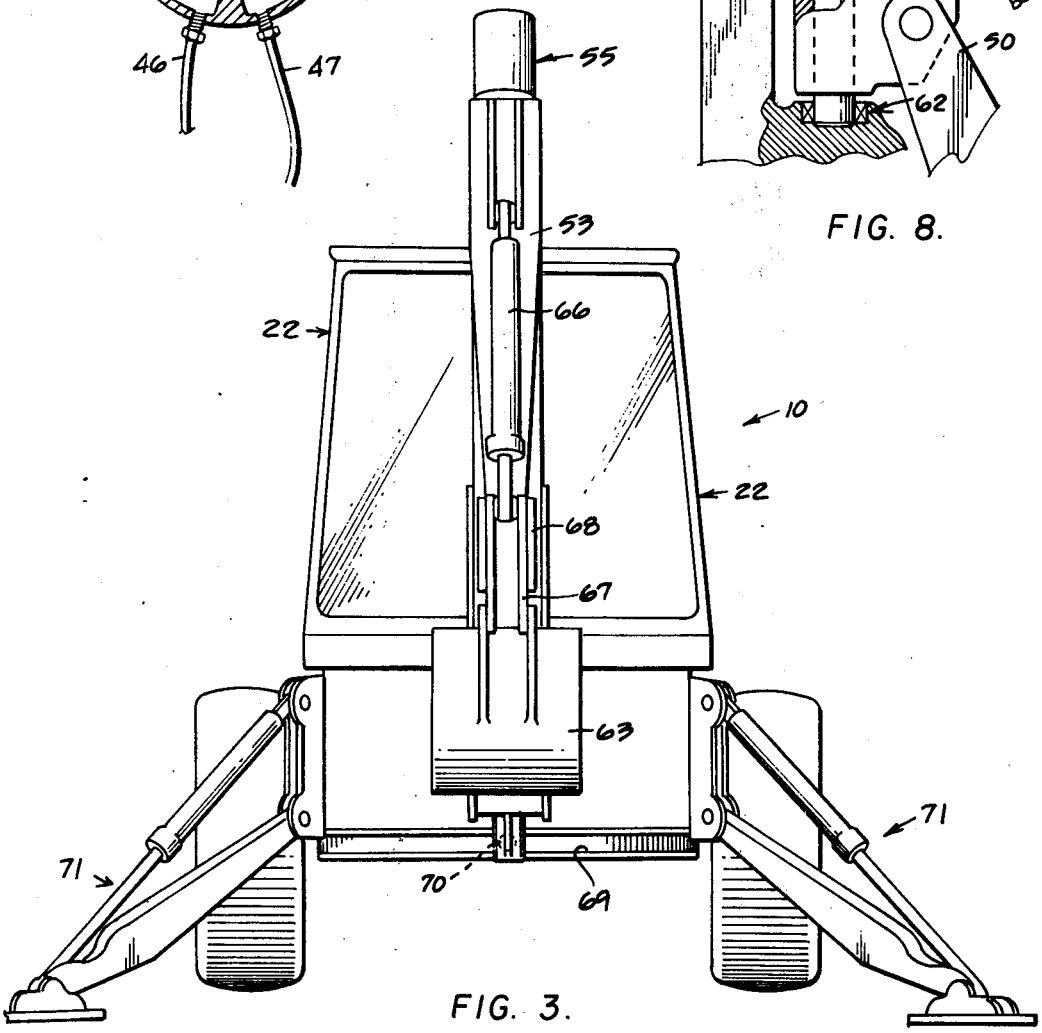
FIG. 3 is a back elevational view of the backhoe.

FIGS. 1-3 illustrate a construction vehicle in the form of a backhoe 10 comprising a tractor 11 mounted for movement on ground-engaging wheels. The frame of the tractor is articulated at a universal pivot means 12, preferably comprising a ball and socket connection. A pair of double-acting hydraulic cylinders 13 are pivotally interconnected by ball and socket connections between a front frame 14 and a rear frame 15 of the backhoe for steering purposes.

A single link 16 is disposed vertically below pivot means 12. The like is pivotally interconnected between the front and rear frames by universal pivot means comprising ball and socket connections 17 and 18, respectively. The above described connection means will thus allow slight relative vertical movement of frames 14 and 15 upon steering of the vehicle.

An engine, schematically illustrated at 21, is mounted on the front frame whereas an operator's cab 22 is suitably mounted on the rear frame. The rear frame has an elongated support member or beam 23 pivotally mounted thereon by a first pivot means 24 for permitting horizontal pivotal movements of the support member relative to rear frame 15. As shown in FIGS. 1 and 2, such pivot means is disposed at the approximate longitudinal center of the backhoe and comprises a vertically disposed pivot pin 25 secured to a pair of vertically spaced projections 26 of the support member.

A pair of vertically spaced clevises 27 are secured to rear frame 15 to rotatably mount the ends of shaft 25 therein by suitably arranged bearing means (not shown). A first actuating means 28 is operatively interconnected between the support member and rear frame for selectively pivoting the support member about pivot means 24. Such actuating means may comprise a pair of double-acting hydraulic cylinders 29 pivotally connected at their forward ends to the rear frame and having their rearward or rod ends connected to a chain 30. The chain is entrained about a sprocket 31, suitably secured to pivot pin 25, whereby alternate extension and retraction of the cylinders will rotate the sprocket and pin 25 to swing support member 23 about the vertical axis thereof.

The rearward end of the support member comprises a pair of vertically spaced upper and lower brackets 32 and 33, respectively. The lower bracket is pivotally mounted by a second pivot means 34 on a clevis 35, formed integrally on a bracket 36 of a boom assembly. Upper bracket 32 forms a clevis having a projection 37 of bracket 36 pivotally mounted therein.

Referring to FIG. 6, a second actuating means 38, preferably in the form of a conventional hydraulic swing motor, has a drive or output shaft 39 extending downwardly therefrom. The lower end of the shaft is attached to bracket 37 at a key and slot or other suitable connection 40. Standard annular bearings 41 are provided to rotatably mount the shaft in bracket 32.

Figure 7:
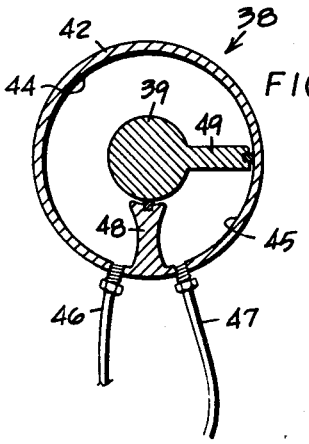
FIG. 7 is a cross sectional view of the swing motor, taken in the direction of arrows VII—VII in FIG. 6.

The swing motor further comprises a housing 42, suitably secured to support member 23 by a bracket 43 or the like. Referring to FIG. 7, the housing defines closed and isolated chambers 44 and 45 therein adapted to be selectively supplied with a pressurized fluid via flexible lines 46 and 47, respectively, communicating with the chambers on either side of a stationary vane 48 secured to the housing. A movable vane 49 is secured to shaft 39 to selectively pivot bracket 36 on the rear frame upon alternate communication and exhaust of fluid via lines 46 and 47 in a conventional manner.

The boom assembly further comprises a boom 50, suitably attached to bracket 36 for horizontal swinging movements therewith. A dipper stick assembly is pivotally mounted on an upper end of the boom by third pivot means comprising a pivot pin 51. The dipper stick assembly comprises a support bracket 52 pivotally connected to the boom at pin 51 and a dipper stick 53 extending downwardly therefrom.

Figure 8:
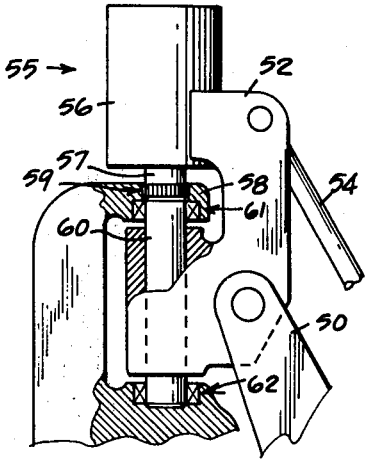
FIG. 8 is an enlarged and partially sectioned side elevational view of a second hydraulic swing motor and mounting therefor.

A third actuating means, preferably in the form of a double-acting hydraulic cylinder 54, is pivotally interconnected between boom 50 and bracket 52 for selectively pivoting the dipper stick assembly vertically on the boom. A fourth actuating means 55, preferably in the form of a second hydraulic swinging motor, is operatively interconnected between bracket 52 and dipper stick 53 to selectively rotate the dipper stick relative to the bracket. Referring to FIG. 8, the swing motor comprises a housing 56 suitably secured to bracket 52 and a drive or output shaft 57 extending downwardly therefrom.

The lower end of the shaft is suitably attached to an upper arm 58 of a clevis, formed on the upper end of the dipper stick, by a spline connection 59, for example. A pivot pin 60 is suitably secured to bracket 52 and has its upper end rotatably mounted in a first annular bearing assembly 61, suitably mounted in arm 58. The lower end of the pivot pin is suitably mounted for rotation in a second annular bearing assembly 62, mounted on the lower arm of the clevis of the dipper stick. The construction, arrangement and function of the drive motor are the same as those shown and described in regard to swing motor 38 of FIG. 7.

The lower end of dipper stick 53 has a bucket 63 pivotally mounted thereon by a fourth pivot means comprising a pivot pin 64. A fifth actuating means 65 for selectively pivoting the bucket on the dipper stick preferably comprises a double-acting cylinder 66 having its upper end pivotally attached to the dipper stick. The lower rod end of the cylinder is pivotally connected to pairs of conventional links 67 and 68, pivotally connected to the bucket and dipper stick, respectively.

Figure 4A:
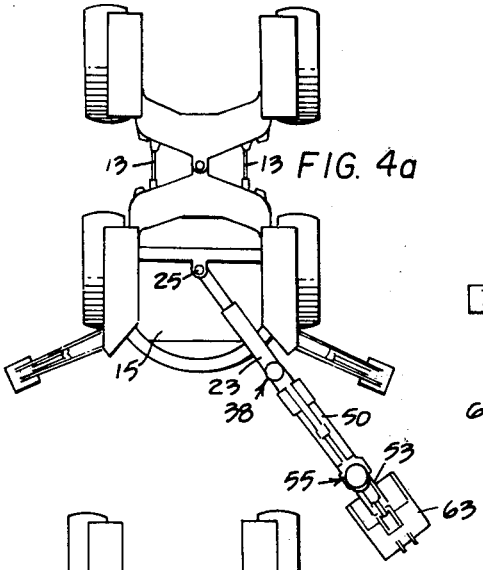
FIGS. 4*a* through 4*e* are reduced top elevational views similar to FIG. 2, but illustrating the backhoe in various positions of operation.

FIGS. 4*a*–4*e* illustrate the backhoe in various conditions of operation to thus illustrate the work capabilities thereof. In FIG. 4*a*, hydraulic cylinders 29 (FIG. 2) have been suitably actuated to rotate support member 23 towards the right side of the backhoe as viewed in this figure. It should be noted in FIGS. 1–3 that a horizontally disposed arcuate track 69 is preferably secured on rear frame 15 to engage a support roller 70 attached to support member 23. A combined support and guide means is thus provided for supporting and guiding the support member upon pivoting thereof relative to the frame.

Figure 4B:
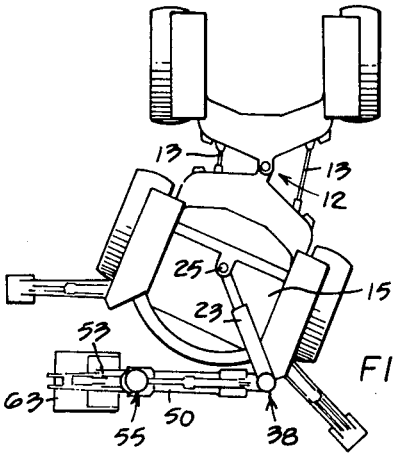
Figure 4C:
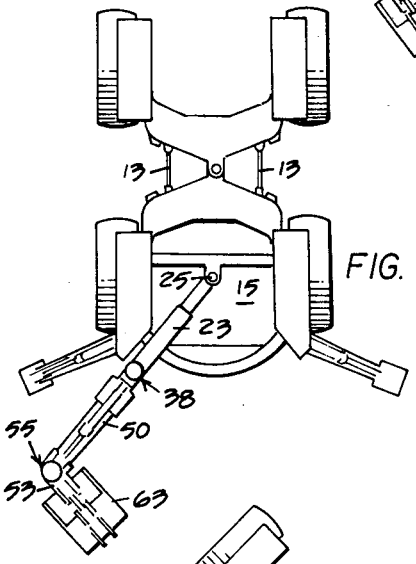

FIG. 4*b* illustrates support member 23 in its same position relative to frame 15, but with hydraulic motor 38 actuated to pivot boom 50 towards the leftside of the backhoe. FIG. 4*c* illustrates a condition wherein the boom is moved to a left side of the machine by cylinders 28 (FIG. 2) and motor 55 is actuated to rotate dipper stick 53 counterclockwise on the boom.

Figure 4D:
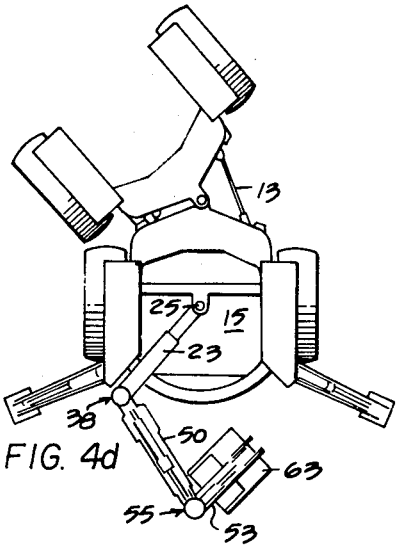
Figure 4E:
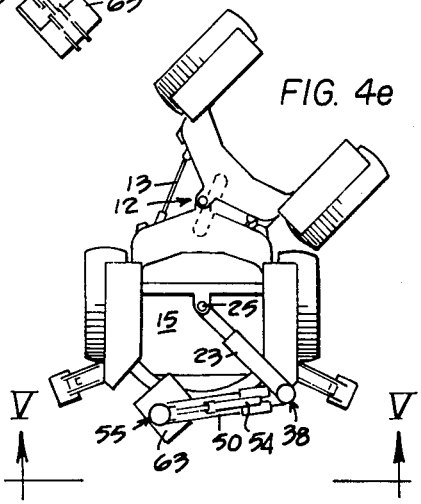
Figure 5:
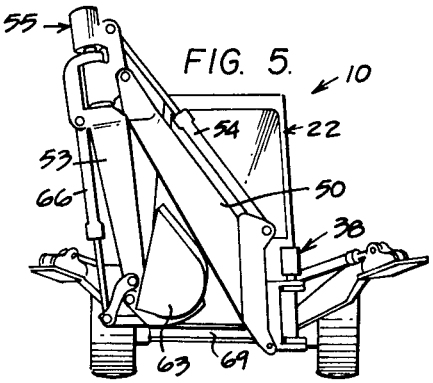
FIG. 5 is a back elevational view of the backhoe, taken in the direction of arrows V—V in FIG. 4*e;*

FIG. 4*d* illustrates a progression from the FIG. 4*c* condition wherein motor 38 is also actuated to pivot the boom counterclockwise on support member 23 to move bucket 63 towards the right or opposite side of the backhoe. FIG. 4*e* illustrates a storage condition wherein cylinders 28 have been actuated to move support member 23 to the right side of the backhoe, motor 38 has been actuated to pivot boom 50 in close proximity to a backside of the backhoe and cylinders 54 and 66 have been extended to respectively pivot the dipper stick and bucket in close proximity to the boom. FIG. 5 more clearly shows the latter positioning of the bucket relative to the boom and also the raising of hydraulically actuated stabilizing means 71, pivotally mounted on either side of frame 15 and disposed longitudinally between pivot means 24 and the boom assembly.

Figure 10:
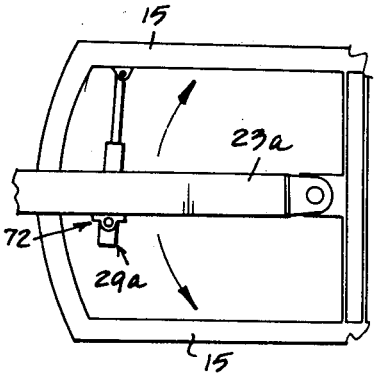
FIG. 10 is a top plan view of the FIG. 9 actuating means.
Figure 9:
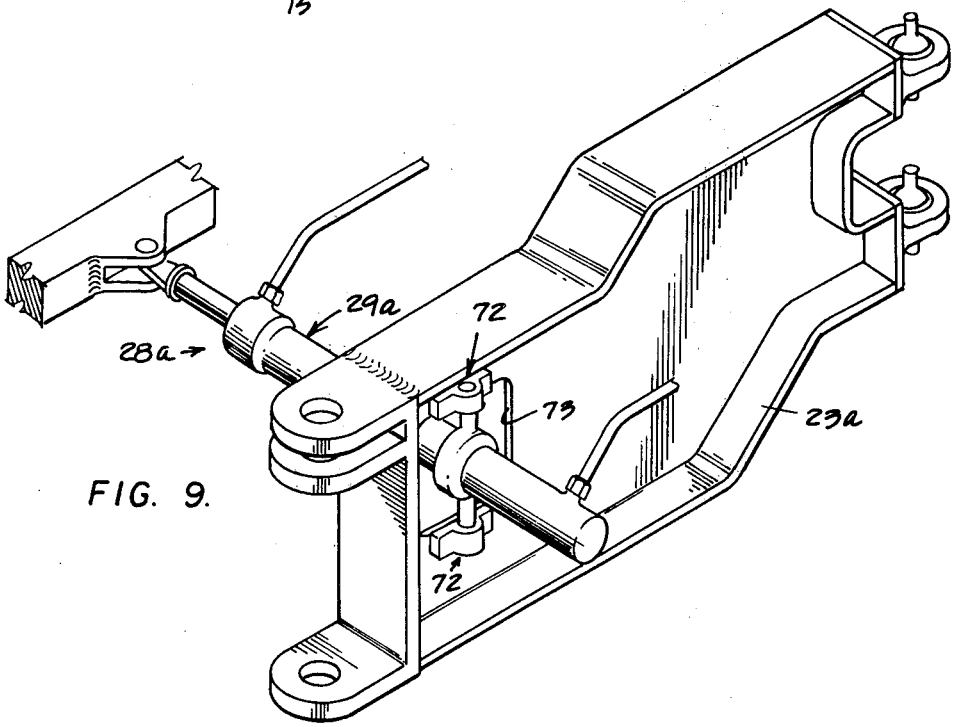
FIG. 9 is an isometric view of a modification of an actuating means employed in the backhoe.

FIGS. 9 and 10 illustrate a modification 28*a* of actuating means 28 (FIG. 2). In particular, a double-acting hydraulic cylinder 29*a* has its rod end pivotally connected to rear frame 15 and its housing pivotally mounted by trunnions 72 on a modified support member 23*a* having an enlarged opening 73 formed therethrough. Thus, selective extension or retraction of the cylinder will pivot the support member relative to frame 15.

Figure 11:
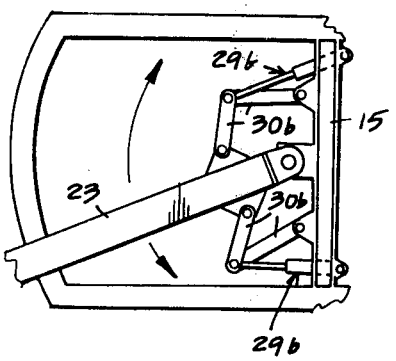
FIG. 11 is a top plan view of a further modification of the actuating means.

FIG. 11 illustrates a further modification of actuating means 28 wherein a pair of double-acting hydraulic cylinders 29*b* function to selectively pivot support member 23 relative to frame 15. The head end of each cylinder is pivotally mounted on the frame whereas the rod end thereof is pivotally connected to first ends of a pair of links 30*b*. A first link has its second end pivotally mounted on the frame whereas the second end of the second link is pivotally mounted on the support member.

Figure 12:
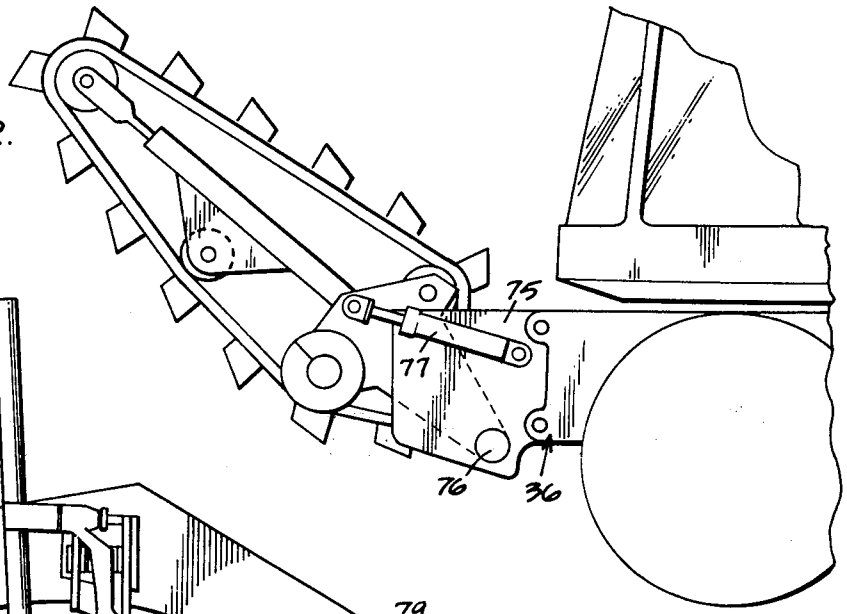
FIG. 12 is a partial side elevational view of the backhoe, but with the backhoe assembly thereof having been replaced by a trencher assembly.

FIG. 12 partially illustrates a construction vehicle of the type described above, except that a trenching assembly has been substituted in lieu of the backhoe assembly (boom 50, dipper stick 53, bucket 63, etc.). The trenching assembly comprises a support 75 suitably attached to bracket 36 (FIG. 1) having the frame of the trencher assembly pivotally mounted thereon by a shaft 76. A double-acting hydraulic cylinder 77 is pivotally interconnected between the frame of the trenching apparatus and support 75 for selectively raising (FIG. 12) and lowering the same relative to ground level.

Figure 13:
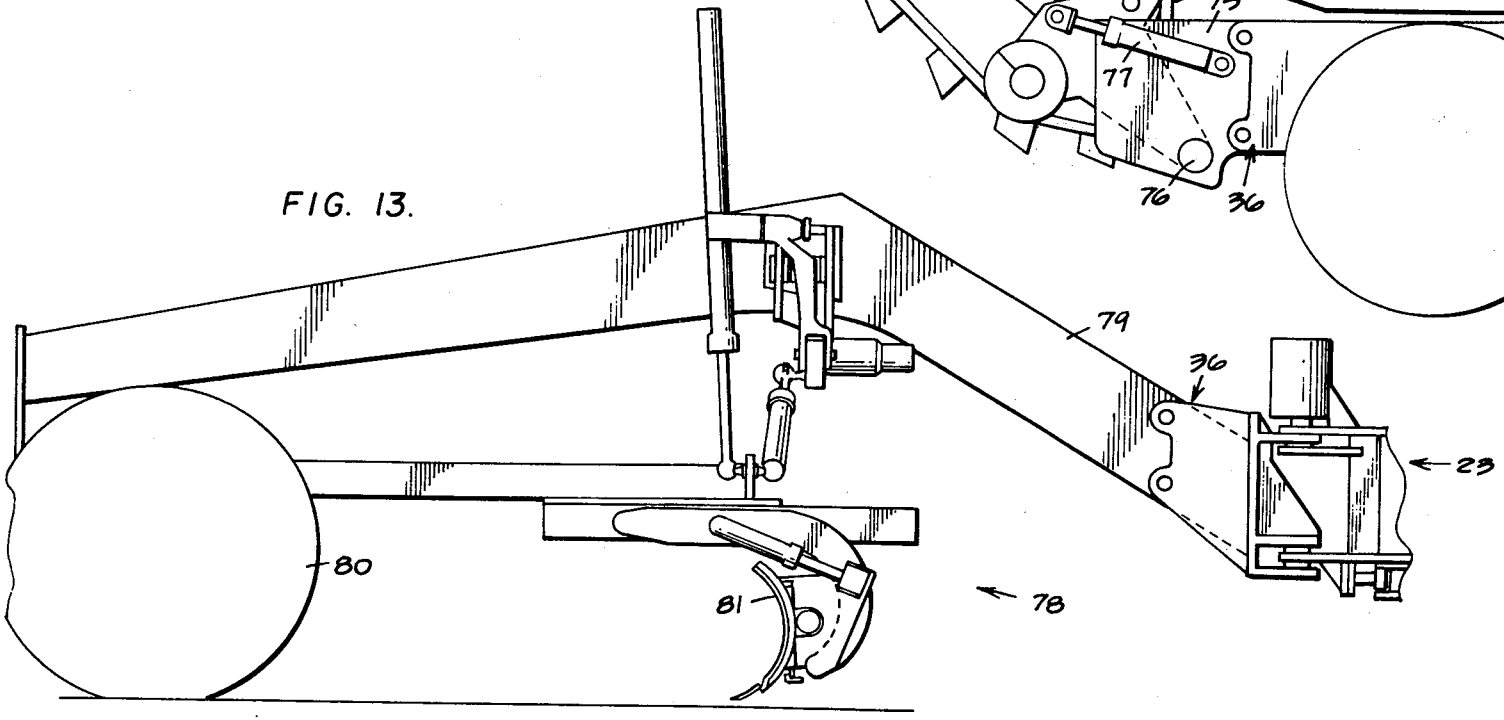
FIG. 13 is a partial side elevational view of the backhoe, but with the backhoe apparatus thereof having been replaced by a grader assembly.

FIG. 13 partially illustrates a construction vehicle wherein a grader assembly 78 has been substituted in lieu of the above-described backhoe assembly. A support frame 79 of the scraper assembly is suitably attached to support member 23 and has a mold board 81 movably mounted thereon in a conventional manner and is supported on a pair of roadwheels 80 (one shown).

I claim:

1. In an articulated construction vehicle of the type comprising a front frame, a rear frame and connection means pivotally interconnecting said front and rear frames together, the improvement wherein said connection means comprises a single universal pivot means pivotally interconnecting said front and rear frames together directly for relative pivotal and vertical movement and a single link means disposed below and at least in general vertical alignment with respect to said pivot means and universally interconnected by universal connections between said front and rear frames, said universal pivot means disposed longitudinally between the universal connections connecting said link means to said front and rear frames and further and continuously disposed in longitudinal alignment with respect to the universal connection connecting said link means to said rear frame whereby upon relative articulation of said front and rear frames about said universal pivot means said link means will pivot about the universal connection connecting said link means to said rear frame and said front frame and said link means are permitted vertical movements relative to said rear frame.

2. The vehicle of claim 1 further comprising a pair of laterally spaced double-acting hydraulic steering cylinders disposed on either side of said pivot means and pivotally interconnected between said front and rear frames for selectively pivoting said front frame relative to said rear frame.

3. The vehicle of claim 1 wherein said pivot means constitutes a ball and socket connection and wherein said link means is pivotally connected to each of said front and rear frames by a ball and socket connection.

4. The vehicle of claim 1 wherein said link means constitutes a single link.

5. The vehicle of claim 1 further comprising a support member pivotally mounted on said rear frame for horizontal pivotal movements relative thereto, said support member extending rearwardly from said vehicle and having a work tool assembly mounted thereon.

6. The vehicle of claim 5 wherein said work tool assembly constitutes a backhoe assembly.

7. The vehicle of claim 5 wherein said work tool assembly constitutes a trenching assembly.

8. The vehicle of claim 5 wherein said work tool assembly constitutes a grader assembly.

* * * * *